United States Patent [19]

Kim et al.

[11] Patent Number: 4,944,915

[45] Date of Patent: Jul. 31, 1990

[54] COPPER ALLOYS FOR ELECTRICAL AND ELECTRONIC PARTS AND ITS MANUFACTURING PROCESS

[75] Inventors: Young G. Kim, Seoul; Yun S. Lim, Inchon, both of Rep. of Korea

[73] Assignee: Poongsan Corporation, Seoul, Rep. of Korea

[21] Appl. No.: 363,535

[22] Filed: Jun. 8, 1989

[30] Foreign Application Priority Data

Dec. 21, 1988 [KR] Rep. of Korea ..... 17124/1988

[51] Int. Cl.[5] ..... C22C 9/04

[52] U.S. Cl. ..... 420/479; 148/434

[58] Field of Search ..... 420/479; 148/434

[56] References Cited

U.S. PATENT DOCUMENTS

| | | | |
|---|---|---|---|
| 1,907,219 | 5/1933 | Sieg | 420/479 |
| 2,101,625 | 12/1937 | Munson | 420/479 |
| 2,101,626 | 12/1937 | Munson | 420/479 |
| 2,400,234 | 5/1946 | Hudson | 148/434 |
| 3,544,313 | 12/1970 | Sadoshima et al. | 148/434 |
| 3,635,702 | 1/1972 | Badia et al. | 420/479 |
| 4,191,564 | 3/1980 | Hirao et al. | 420/479 |
| 4,233,068 | 11/1980 | Smith, Jr. et al. | 148/434 |
| 4,233,069 | 11/1980 | Smith, Jr. et al. | 148/434 |
| 4,242,131 | 12/1980 | Shapiro et al. | 148/434 |
| 4,242,132 | 12/1980 | Shapiro et al. | 420/479 |
| 4,242,133 | 12/1980 | Shapiro et al. | 148/434 |
| 4,632,806 | 12/1986 | Morikawa et al. | 420/479 |
| 4,676,848 | 6/1987 | Ruchel et al. | 148/434 |
| 4,874,439 | 10/1989 | Akutsu | 148/434 |

FOREIGN PATENT DOCUMENTS

| | | |
|---|---|---|
| 3805794 | 9/1988 | Fed. Rep. of Germany . |
| 3809994 | 10/1988 | Fed. Rep. of Germany . |
| 56-166353 | 12/1981 | Japan . |
| 57-76143 | 5/1982 | Japan . |
| 59-25939 | 2/1984 | Japan . |
| 59-53645 | 3/1984 | Japan . |
| 60-114545 | 6/1985 | Japan . |
| 60-174842 | 9/1985 | Japan . |
| 61-133357 | 6/1986 | Japan . |
| 63-128142 | 5/1988 | Japan . |
| 63-130738 | 6/1988 | Japan . |
| 63-206440 | 8/1988 | Japan . |
| 63-206441 | 8/1988 | Japan . |
| 63-213628 | 9/1988 | Japan . |
| 64-00239 | 1/1989 | Japan . |
| 64-55346 | 3/1989 | Japan . |
| 64-55347 | 3/1989 | Japan . |
| 64-55348 | 3/1989 | Japan . |

*Primary Examiner*—John F. Niebling
*Assistant Examiner*—David W. Schumaker
*Attorney, Agent, or Firm*—Lieberman Rudolph & Nowak

[57] ABSTRACT

Copper alloys for electrical and electronic parts and its manufacturing process are disclosed. The copper alloys consist essentially of 20 to 27% Zinc, 2 to 5% Aluminum, 0.5 to 5.0% Nickel, 0.1 to 1% Silicon, and 0.01 to 0.5% Zirconium. The copper alloys are produced by hot and cold rolling, followed by a stress relief heat treatment. The copper alloys of the initial invention exhibit high strength with good spring characteristics and are advantageously used for electric and electronic parts such as connectors, springs, relays, contacts and switches.

1 Claim, No Drawings

COPPER ALLOYS FOR ELECTRICAL AND ELECTRONIC PARTS AND ITS MANUFACTURING PROCESS

FIELD OF THE INVENTION

The present invention relates to copper alloys for electrical and electronic parts and, more particularly, to a new and improved copper alloy with good spring characteristics for connector and spring applications, along with a manufacturing process for such new and improved copper alloys.

BACKGROUND OF THE INVENTION

The materials used for electrical and electronic components, such as connectors, springs, relays, contacts and switches, are required to possess high strength and good spring characteristics. High strength copper based alloys are currently used, with the most widely used copper based alloys being phosphor bronzes (CDA 510, CDA 511), and beryllium copper alloys (CDA 172, CDA 175).

Since phosphor bronzes contain a relatively high content (5 wt/%) of tin, the manufacturing process is difficult due to the segregation of tin during solidification. In addition, the cost of phosphor bronzes is higher due to the high content of expensive tin elements, in addition to the complex manufacturing processes.

Segregation of the tin element should be minimized during solidification, and the rolling conditions should be carefully controlled to avoid cracking during the thermomechanical processing. However, the mechanical properties of phosphor bronze (CDA 510) are inferior to those of beryllium copper alloys for electrical component applications.

Although beryllium copper alloys possess excellent mechanical properties with good electrical and thermal conductivity, the cost of these alloys is very high due to the beryllium content. Also, the use of beryllium alloys may create a health hazard problem when used, as the presence of beryllium requires that adequate safety precautions be mandatory for all melting, grinding, machining and welding operations.

A prior art copper alloy is disclosed in the specification of Japanese Patent Application No. SHO 52-5219 to Kokai. However, this particular alloy does not demonstrate an increase in tensile strength and ductility. A second prior art copper alloy is disclosed in the specification of Japanese Patent Application No. SHO 60-59035 to Kokai. This alloy demonstrates increased tensile strength, but requires the addition of phosphorus. Finally, a third prior art copper alloy is disclosed in the specification of Japanese Patent Application No. SHO 59-25935 to Kokai. This alloy possesses higher wear-resistant properties, rather than increased tensile strength, but requires the use of zinc, zirconium and iron additives.

The purpose of the instant invention is to develop a new low-cost, high performance, copper alloy possessing high strength and spring properties, but without requiring the use of expensive alloy elements. Advantageously, through use of the instant invention, the use of expensive alloy elements such as tin and beryllium is completely eliminated. Instead, large amounts of inexpensive alloy elements, such as zinc and aluminum, are added as major alloy elements to reduce cost. Also, small amounts of microalloy elements, such as silicon and zirconium (below 1%) are added for grain size refinement. Significantly, optimum thermomechanical manufacturing methods are employed to obtain excellent strength and ductility by grain size refinement and excellent spring characteristics are obtained by applying suitable heat treatment.

When utilizing the instant invention for the production of strip or sheet products, cold-rolling is employed. To make cold-rolling possible, the use of a face-centered-cubic (FCC) structure for the base matrix is desirable. In order to enhance the strength of the final product, several solid solution hardening elements can be added to the FCC matrix without forming a second phase, such as a body-centered-cubic (BCC) phase in the copper-zinc system. A very high strength can be obtained by superimposing various strengthening mechanisms such as grain size refinement, cold-rolling, and solid solution hardenings. Good spring characteristics can be achieved by a stress relief heat-treatment after a final cold-rolling process.

SUMMARY OF THE INVENTION

Copper based alloys consisting of 20 to 27% Zn, 2 to 5% Al, 0.5 to 5.0% Ni, 0.1 to 1.0% Si, and 0.01 to 0.5% Zr are melted in an induction furnace. The cast ingots are subjected to homogenization heat treatment at 850°-900° C. for 1-6 hours before hot-rolling. For hot-rolling, the ingot slabs are reheated at 800°-850° C., and then subjected to hot-rolling by using a reversible hot-rolling mill. The hot-rolled plates are annealed at 550°-660° C. for 1-5 hours to produce the desirable FCC alpha phase before cold-rolling. The annealed hot-rolled strips are then subjected to cold-rolling by using a reversible cold-rolling mill. The copper alloys invented have shown a good formability in hot-rolling, as well as in cold-rolling. During the cold-rolling process, the strips were annealed at 450°-500° C. for 1-3 hours after about a 50% reduction in thickness. The thermomechanical treatment produces a fine grain structure for increased strength, as well as ductility of the alloy. The alloy can be used either in cold-rolled strips, or can be subjected to a stress-relief heat-treatment at 200°-300° C. for 30-60 minutes for increasing the spring characteristics.

BRIEF DESCRIPTION OF THE DRAWINGS

FIGS. 1 a, b and c are optical micrographs showing the results of adding Si and Zr to an alloy comprising Cu-23/Zn-3.4/Al-1/Ni, illustrating that the addition of Si and Zr to the alloy greatly reduces the grain size.

FIG. 2 is a transmission electron micrograph of cold-rolled strips of alloy comprising Cu-23/Zn-3.4/Al-1/Ni-0.3/Si-0.1/Zr, showing the dislocation substructure.

FIG. 3 is a comparison of yield and tensile strength of the alloy of the instant invention, with another high performance alloy of phosphor bronze CDA 510, beryllium coppers CDA 175 and CDA 172 alloys, where a typical composition identified as PMC-707 of Cu-23/Zn-3.4/Al-1/Ni-0.3/Si-0.1/Zr (Wt/%) was used for comparison.

DETAILED DESCRIPTION OF THE INVENTION

Alloy Elements and Its Limits

The addition of Zinc (20%-27%) was made as the main solid solution hardener for lowering the cost of the inventive alloy. When Zinc exceeds 27%, two phase transformations can occur, an alpha phase FCC and a BCC beta phase, both of which are deleterious to ductility. When the Zn content is below 20%, the alloy does not exhibit sufficient strength.

An addition of Al (2–5%) was made to the inventive alloy. It was found that an Al amount exceeding 5% resulted in difficulty accomplishing cold-rolling and lower ductility. Conversely, an Al amount of less than 2% would not provide the desired high strength.

An addition of Ni (0.5–5%) was made to improve the ductility of the alloy. Ni is an FCC alpha phase stabilizing element and expands the solubility of Al in the Cu-Zn-Al-X system. A Ni component below 0.5% was not sufficient for ductility improvement, while a Ni component in excess of 5% resulted as an alloy of non-economical cost.

An addition of Si (0.1–1.0 wt/%) was made for grain size refinement and to increase strength. A Si amount less than 0.1% did not produce fine grain size or enough strength. Conversely, an amount of Si exceeding 1 (Wt/%) was deleterious to an improvement in ductility.

The addition of Zr (0.01–1.0 Wt/%) was very important to further reduce the grain size in order to achieve high strength combined with good ductility. The simultaneous addition of Zr with Si resulted in very small grain size with high strength and formability. It was found that when Zr was less than 0.01%, the grain size refinement was not sufficient, while when the Zr component was more than 1%, a possible grain boundary segregation of the alpha phase occurred.

Manufacturing Process

The inventive copper alloy consisting of 20 to 27% Zn, 2 to 5% Al, 0.5 to 5% Ni, 0.1 to 1.0% Si and 0.01–0.5% Zr is melted in an induction furnace under a reducing atmosphere. Commercially pure raw materials of electrolytic Cu, Zn, Al and Ni are used. Pure silicon and zirconium are added. When the melt temperatures are at 1100°–1200° C., the molten metals are poured into a mould. The cast ingots are homogenized at 850°–900° C. for 1–6 hours before hot-rolling. After reheating the ingot at 800°–850° C. for 1–2 hours, the ingots are subjected to hot-rolling by a reversible hot-rolling mill. When a desirable thickness is reached, the ingot is cooled to room temperature. In order to obtain a uniform structure having an equilibrium at the alpha-phase, the hot rolled plates are annealed at 550°–660° C. for 1–5 hours, followed by air cooling. The annealed plates are then subjected to a cold-rolling process without cracking, thereby exhibiting a good cold-rolling formability for the inventive alloy. After about a 70% cold reduction, the cold strips are annealed at 450°–500° C. for 1–3 hours to reduce further thickness. The final cold-rolled strips are annealed at 200°–300° C. for 0.5–1 hours for stress-relief to increase the spring characteristics.

EXAMPLE 1

The chemical compositional alloys (No. 1, 2, 3, 4, 5) in Table 1 were melted by using a high frequency induction furnace. The liquid metals at 1150° C. were poured into a mould having a 50×50×130 mm dimension.

TABLE 1

The Alloy Compositions and Tensile Properties

| | Chemical composition (wt %) | | | | | | Cold-Rolled (50%) | | | Cold Roll (50%) +Annealed at 250° C. 1 hr | | |
|---|---|---|---|---|---|---|---|---|---|---|---|---|
| | Cu | Zn | Al | Ni | Si | Zr | Y. S | UTS | El % | Y. S | UTS | El % |
| Alloy Comparison | | | | | | | | | | | | |
| No. 1 | 73.3 | 22.7 | 3.4 | 0.6 | | | 72 | 74 | 3 | 87 | 90 | 2 |
| No. 2 | 72.6 | 22.7 | 3.4 | 1.0 | 0.3 | | 75 | 80 | 6 | 90 | 93 | 2 |
| No. 3 | 55.42 | 29.5 | 6.0 | 5.5 | 0.08 | 0.6 | 74 | 76 | 3 | 80 | 88 | 2 |
| No. 4 | 79.31 | 17.4 | 1.5 | 0.3 | 1.7 | 0.008 | 72 | 75 | 4 | 79 | 87 | 2 |
| Alloy Invention | | | | | | | | | | | | |
| No. 5 | 72.5 | 22.7 | 3.4 | 1.0 | 0.3 | 0.1 | 81 | 88 | 5 | 97 | 98 | 1.5 |
| Japanese Patent Application KOKAI 52-52119 | 69 | 22 | 8 | 1 | | | 95.9 | 81 | | 82.3 | 85.6 | |
| Japanese Patent Application KOKAI 59-25939 | | | | | | | 75.4 | 75.4 | | | | |

The ingots were homogenized at 900° C. for 1 hour and hot-rolled at 850° C. The hot-rolled plates were annealed at 550° C. for 5 hours. The annealed plates were cold-rolled by applying a 50% reduction. The intermediate annealing treatment at 500° C. for 1 hour was applied between the cold-rolling process. The final plates were annealed at 250° C. for 1 hour for enhancing the spring characteristics.

The resultant mechanical properties of the alloy of the instant invention, such as No. 5 ("PMC-707" in FIG. 3), are compared with those of the phosphor bronze CDA 510 and those of Cu-Be CDA 175. The inventive alloy exceeds the strength of CDA 510, but is inferior to C 175. The inventive alloy exceeds the strength of CDA 510, but is inferior to C 175. The final annealing treatment to the cold-rolled sheet increases the spring characteristic value from 33 Kg/mm2 to 80 Kg/mm2.

EXAMPLE 2

The alloys (No. 6, 7) in Table 2 were melted and cast as in Example 1.

TABLE 2

| | Chemical Composition (wt %) | | | | | | Cold-Rolled (50%) | | | Cold-Rolled (50%) +Annealed at 220° C. 1 hr | | |
|---|---|---|---|---|---|---|---|---|---|---|---|---|
| | Cu | Zn | Al | Ni | Si | Zr | Y. S | UTS | El % | Y. S | UTS | El % |
| Alloy Invention | | | | | | | | | | | | |
| No. 6 | 70 | 25 | 3.5 | 1.0 | 0.3 | 0.1 | 72 | 82 | 5 | 81 | 90 | 2.5 |

TABLE 2-continued

| | Chemical Composition (wt %) | | | | | | Cold-Rolled (50%) | | | Cold-Rolled (50%) +Annealed at 220° C. 1 hr | | |
|---|---|---|---|---|---|---|---|---|---|---|---|---|
| | Cu | Zn | Al | Ni | Si | Zr | Y. S | UTS | El % | Y. S | UTS | El % |
| No. 7 | 69.2 | 25 | 3.5 | 1.5 | 0.3 | 0.5 | 72 | 80 | 5 | 87 | 89 | 1.5 |

The ingots were homogenized at 850° C. for 6 hours. The homogenized ingot was hot-rolled at 800° C. The hot-rolled plate was subjected to two different annealing conditions. The first condition was at 550° C. for 5 hours to obtain the full FCC alpha phase, while the second condition was 700° C. for 1 hour to obtain a mixture of the alpha beta phases. The annealed plates were cold-rolled with a 50% reduction to the full alpha phase plate and the dual alpha and beta phase plates. Cold-cracking occurred for the alpha plus beta phase material when the 50% reduction was applied, but no cold-rolled cracks took place for the alpha phase material for the same reduction (50%). Therefore, a 35% reduction was applied to the alpha plus beta phase material. The final rolled sheets were annealed at 220° C. for 1 hour. The mechanical properties of the alpha plus beta phase material (35% reduction) are summarized in Table 3. When compared with those of the full alpha phase, the properties of the alpha plus beta are inferior to those of the alpha phase material. Therefore, it is essential that the post annealing heat treatment after the hot-rolling should produce the full FCC alpha phase transformation.

TABLE 3

| | Tensile Properties of Alpha Plus Beta Structure | | | | | |
|---|---|---|---|---|---|---|
| | Cold-Rolled (35%) | | | Cold-Rolled + Annealed at 220° C., 1 hr | | |
| | Y. S | UTS | El % | Y. S | UTS | El % |
| No. 6 | 65 | 73 | 4 | 60 | 75 | 3.5 |
| No. 7 | 64 | 76 | 5 | 64 | 79 | 4.5 |

The simultaneous addition of Si and Zr resulted in further grain size refinement as in FIG. 1(C), producing high strength with good ductility.

FIG. 2 shows the dislocation substructure developed by cold-rolling. The dislocation substructure is essential for high strength.

EXAMPLE 3

The following compositional two alloys in Table 4 were melted in an induction furnace, and cast into a rectangular mould.

TABLE 4

| | The Alloy Compositions (Wt %) Investigated & Tensile Properties | | | | | | | | | | | |
|---|---|---|---|---|---|---|---|---|---|---|---|---|
| | Chemical Composition (wt %) | | | | | | Cold-Rolled | | | Cold-Rolled + Annealed | | |
| | Cu | Zn | Al | Ni | Si | Zr | Y. S | UTS | El % | Y. S | UTS | El % |
| Alloy Invention | | | | | | | | | | | | |
| No. 8 | 73.1 | 20.5 | 4.8 | 0.5 | 0.8 | 0.3 | 79 | 86 | 5 | 92 | 94 | 2.0 |
| No. 9 | 66.9 | 26.5 | 1.9 | 4.5 | 0.2 | 0.04 | 77 | 84 | 5 | 90 | 92 | 2.0 |

After the homogenized treatment at 850° C. for 5 hours, the ingots were hot-rolled after reheating at 800° C. The hot-rolled plates were annealed at 600° C. and 650° C. for 3 hours and 1 hour to obtain a thermodynamic equilibrium phase of an FCC alpha phase.

The annealed plates were cold-rolled (60% and 70%) in several passes in which the thickness was reduced.

The secondary cold-rolling was performed after annealing the first cold-rolling strips at 500° C. and 450° C. for 1.5 hours and 2.5 hours.

In order to investigate the effects of low temperature annealing heat-treatment on mechanical properties, the final cold-rolled strips were annealed at 300° C. and 250° C. for 30 minutes and 40 minutes. The results are summarized in Table 4.

What is claimed is:

1. A copper alloy having high strength and excellent spring characteristics, consisting of 20 to 27% Zinc, 2.0 to 5.0% Aluminum, 0.5 to 5.0% Nickel, 0.1 to 1.0% Silicon, 0.01 to 0.5% Zirconium, and the balance copper.

* * * * *